US007457574B2

(12) United States Patent
Spence et al.

(10) Patent No.: US 7,457,574 B2
(45) Date of Patent: Nov. 25, 2008

(54) FUSER ROLL EDGE WEAR SMOOTHING SYSTEM AND METHOD

(75) Inventors: James J. Spence, Honeoye Falls, NY (US); Steven M. Russel, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 232 days.

(21) Appl. No.: 11/640,564

(22) Filed: Dec. 18, 2006

(65) Prior Publication Data

US 2008/0145115 A1 Jun. 19, 2008

(51) Int. Cl.
*G03G 15/20* (2006.01)

(52) U.S. Cl. ..... 399/322; 399/394

(58) Field of Classification Search ..... 399/107, 399/122, 320, 322, 323, 328, 329, 394, 395, 399/396; 219/216
See application file for complete search history.

(56) References Cited

U.S. PATENT DOCUMENTS 4,971,304 A 11/1990 Lofthus
5,337,133 A 8/1994 Siegel et al.
5,725,211 A 3/1998 Blanchard et al.
5,848,344 A * 12/1998 Milillo et al. ..... 399/395
6,137,517 A 10/2000 Furst et al.
6,246,858 B1 * 6/2001 Condello et al. ..... 399/329
6,910,689 B2 6/2005 Carolan
6,982,781 B2 1/2006 Vetromile et al.
7,013,107 B2 3/2006 Russel et al.
2007/0140751 A1 * 6/2007 Eun et al. ..... 399/322

* cited by examiner

*Primary Examiner*—Hoan H Tran
(74) *Attorney, Agent, or Firm*—Fay Sharpe LLP

(57) ABSTRACT

This disclosure provides a printing apparatus and method including a media sheet registration system, a fuser roll assembly and a fuser roll RDS (registration distribution system). The media sheet registration system steers media sheets to alternative target positions to smooth fuser roll edge wear area profiles associated with the RDS and media sheets passing through the fuser roll assembly.

20 Claims, 7 Drawing Sheets

FUSER ROLL EDGE WEAR SMOOTHING SYSTEM AND METHOD

BACKGROUND

This disclosure relates to a xerographic printing system and method of operation, specifically, this disclosure relates to a system and method of fixing a toner image to a substrate utilizing a moveable fusing device.

In electrostatic printing, a dry marking material such as a toner is fused to a substrate, such as a media sheet or paper sheet. The fusing process occurs after the toner is transferred to the substrate by an electrostatic printing device and before the marked substrate is subjected to any processes which may disturb the placement of the toner on the substrate. Fusing occurs when the substrate is subjected to pressure and heat to permanently affix the toner material to the substrate. Conventionally, the fuser device includes a fuser roll and a pressure roll that form a nip for the marked substrate to pass through. The fusing device may be configured to provide fusing of a variety of different size media sheets.

Xerographic fusing devices suffer from edge wear due to the conformable material used on the fuser roll and/or pressure rolls. Edge wear is a well known condition and is a result of the edges of multiple media sheets passing through a fuser roll assembly, wherein the edge of the media sheets cut or wear into the fuser roll conformable material. In other words, the sheet edges produce a stress concentration as they pass through the fuser nip under pressure, causing the fuser roll thin surface coating and elastomeric layer under the surface to degrade. The degradation of the fuser roll is often manifested as a narrow area of low gloss from a leading edge to a trailing edge across the toner fused to the substrate. To correct for fuser edge wear, the fusing device or roller is replaced.

To address fuser edge wear and extend the useful life of a fusing roll, U.S. Pat. No. 7,013,107 discloses a system and method comprising a continuously moving fuser assembly. By continuously moving the fuser assembly, differential gloss artifacts due to media sheet edges wearing into the fuser roll are spread out over a greater area which extends fuser roll life. Notably, the system and method disclosed U.S. Pat. No. 7,013,107 does not depend on knowing the size of the media sheets prior to fusing.

This disclosure provides a printing system and method which incorporates a media sheet registration and fuser roll RDS (Registration Distribution System) to extend the life of a fuser roll by moving a fuser roll to spread out the edge wear area and controlling the registration of media sheets to smooth out the boundaries of the RDS produced edge wear area.

INCORPORATION BY REFERENCE

U.S. Pat. No. 7,013,107, issued Mar. 14, 2006 to Russel et al., entitled "SYSTEMS AND METHODS FOR CONTINUOUS MOTION REGISTRATION DISTRIBUTION WITH ANTI-BACKLASH AND EDGE SMOOTHING";

U.S. Pat. No. 6,982,781, issued Jan. 3, 2006 to Vetromile et al., entitled "AUTOMATIC FUSER CONTROL";

U.S. Pat. No. 6,137,517, issued Oct. 24, 2000 to Furst et al., entitled "IMAGE REGISTRATION ADJUSTMENT SYSTEM AND METHOD FOR DYNAMICALLY COMPENSATING FOR PHOTORECEPTOR BELT SKEW";

U.S. Pat. No. 5,725,211, issued Mar. 10, 1998 to Blanchard et al., entitled "METHOD AND APPARATUS FOR REGISTERING IMAGES ON THE FRONT AND THE BACK OF A SINGLE SHEET OF PAPER"; and U.S. Pat. No. 4,971,304, issued Nov. 20, 1990 to Lofthus, entitled "APPARATUS AND METHOD FOR COMBINED DESKEWING AND SIDE REGISTERING" are totally incorporated by reference.

BRIEF DESCRIPTION

In one aspect of this disclosure, a printing apparatus is disclosed. The printing apparatus comprises a media sheet registration system; an image transfer device operatively connected to the media sheet registration system; a fuser roll assembly operatively connected to the image transfer device; and a fuser roll registration distribution system (RDS) operatively connected to the fuser roll assembly, wherein the fuser roll registration distribution system changes the position of the fuser roll assembly to increase the fuser roll assembly edge wear area associated with media sheet edges passing through the fuser roll assembly, and the printing apparatus is adapted to steer a sequence of media sheets to a plurality of media sheet registration positions to smooth the fuser roll assembly edge wear area associated with media sheet edges passing through the fuser roll assembly.

In another aspect of this disclosure, a method is disclosed of smoothing the edge wear area associated with a fuser roll assembly operatively connected to a fuser roll assembly registration distribution system (RDS), the roll RDS driving the fuser roll assembly laterally back and forth within an outboard travel limit and an inboard travel limit, the method comprises registering one or more media sheets at a first target position while the RDS drives the fuser roll assembly substantially between the outboard travel limit and the inboard travel limit; and registering one or more media sheets at a second target position while the RDS operates in a dwell mode and/or reverse mode.

In another aspect of this disclosure, a method is disclosed of operating a printing system. The printing system comprises a media sheet registration system; an image transfer device operatively connected to the media sheet registration system; a fuser roll assembly operatively connected to the image transfer device; and a fuser roll registration distribution system (RDS) operatively connected to the fuser roll assembly, wherein the RDS travels back and forth in a lateral direction within a predetermined outboard travel limit and inboard travel limit to increase the fuser roll assembly edge wear area associated with media sheet edges passing through the fuser roll assembly. The method of operating the printing system comprises registering one or more media sheets at a first target position prior to image marking the one or more media sheets and while the RDS travels in a lateral direction substantially between the outboard travel limit and the inboard travel limit; transferring an image from the image marking device to the one or more media sheets, wherein the image is registered on the media sheets relative to the first target position; fusing the image on the one or more media sheets while the fuser roll assembly is positioned between the RDS outboard travel limit and the RDS inboard travel limit; determining the fuser roll assembly RDS is in a dwell mode of operation and/or a reversing mode of operation, wherein the fuser roll assembly is substantially positioned at the outboard travel limit or inboard travel limit; registering one or more media sheets at a second target position prior to image marking the one or more media sheets; transferring an image from the image marking device to the one or more media sheets, wherein the image is registered no the media sheets relative to the second target position; fusing the image on the one or more media sheets while the fuser roll assembly is substantially positioned at the outboard travel limit or inboard travel limit; and determining the fuser roll assembly RDS is operating at a predetermined distance from the outboard travel limit and inboard travel limit; and returning to registering one or more media sheets at the first target position prior to image marking the one or more media sheets and while the RDS travels in a lateral direction substantially between the outboard travel limit and the inboard travel limit.

DETAILED DESCRIPTION

Figure 7:
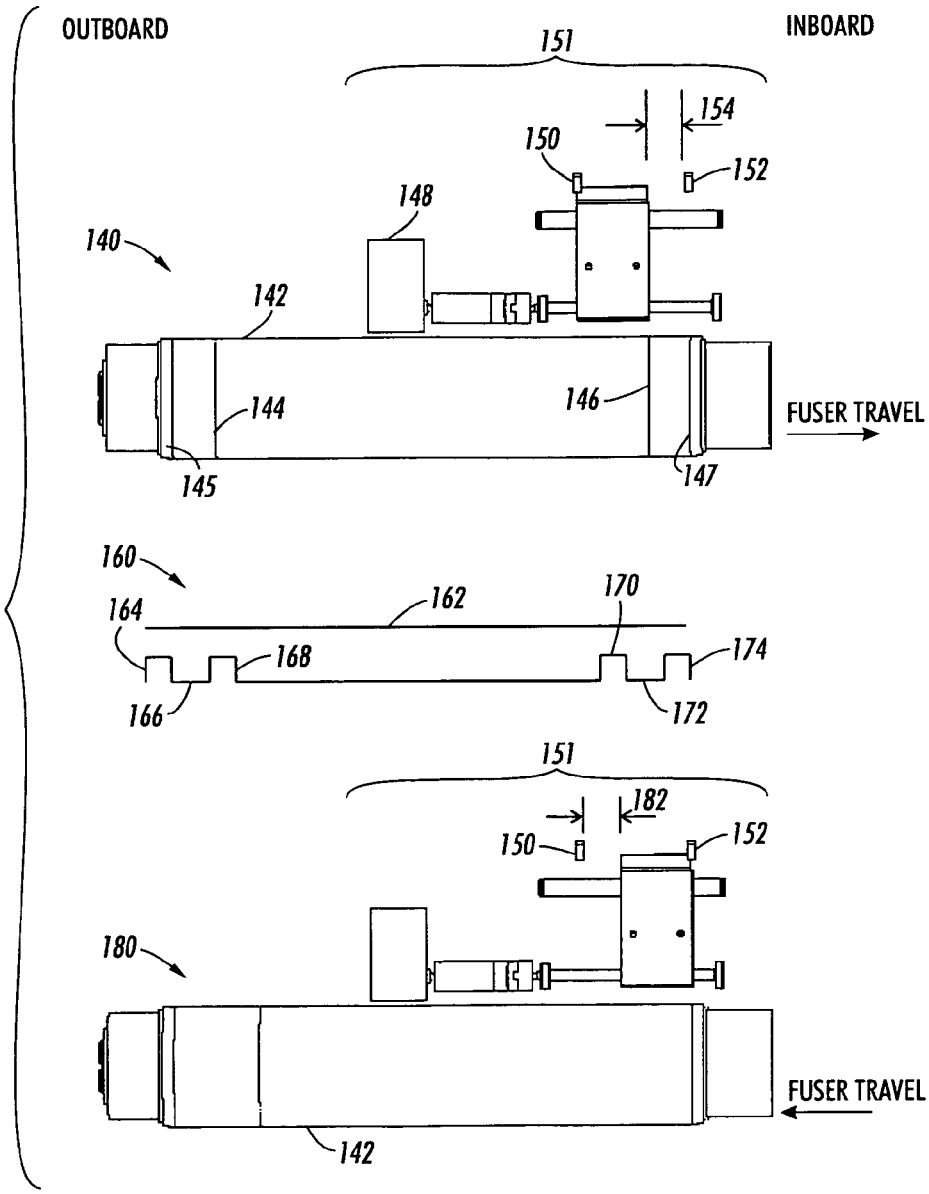
FIG. 7 illustrates a conventional fuser assembly RDS.

As previously discussed in the background section of this disclosure, this disclosure provides a system and method related to the fusing of a media sheet to increase the useful life of a fuser roll. The disclosed system and method utilize a fuser roll RDS and media sheet registration system to effectively smooth out edge wear boundaries produced by a fusing roll RDS. With reference to FIG. 7, illustrated is a fuser roll system including a fuser roll RDS. The following discussion with reference to FIG. 7 provides a basis for understanding the fuser roll edge wear problem addressed by this disclosure.

With continuing reference to FIG. 7, diagram 140 illustrates a fuser roll RDS at the outboard travel limit and diagram 180 illustrates a fuser roll RDS at the inboard travel limit. Diagram 160 illustrates a media sheet/fuser roll alignment and the associated edge wear areas.

With reference to diagrams 140 and 180, the fuser roll RDS comprises a fuser roll 142, a RDS 151, a RDS travel outboard limit sensor 150 and a RDS travel inboard limit sensor 152. In operation, the fuser roll RDS motor 148 moves the fuser roll 142 laterally back and forth between outboard limit sensor 150 and inboard limit sensor 152 a predetermined travel distance 154. As illustrated by outboard edge wear boundaries 145 and 144, and inboard edge wear boundaries 146 and 147, the repetitive fusing of media sheets registered at a fixed position produces edge wear boundaries. These edge wear boundaries eventually produce image artifacts on a marked media sheet which are visible to a user of the printing system.

With reference to diagram 160, illustrated is a more detailed view of the fuser roll edge wear area and the relative position of a media sheet 162. Outboard edge wear areas 164 and 168, and inboard edge wear areas 170 and 174 illustrate the effects of RDS dwelling and RDS reversing after the fuser roll 142 reaches the outboard and inboard travel limit. Edge wear area 166 and 172 illustrates much less of an edge wear effect while the fuser roll travels substantially within the limits of the outboard limit sensor 150 and inboard limit sensor 152.

Figure 1:
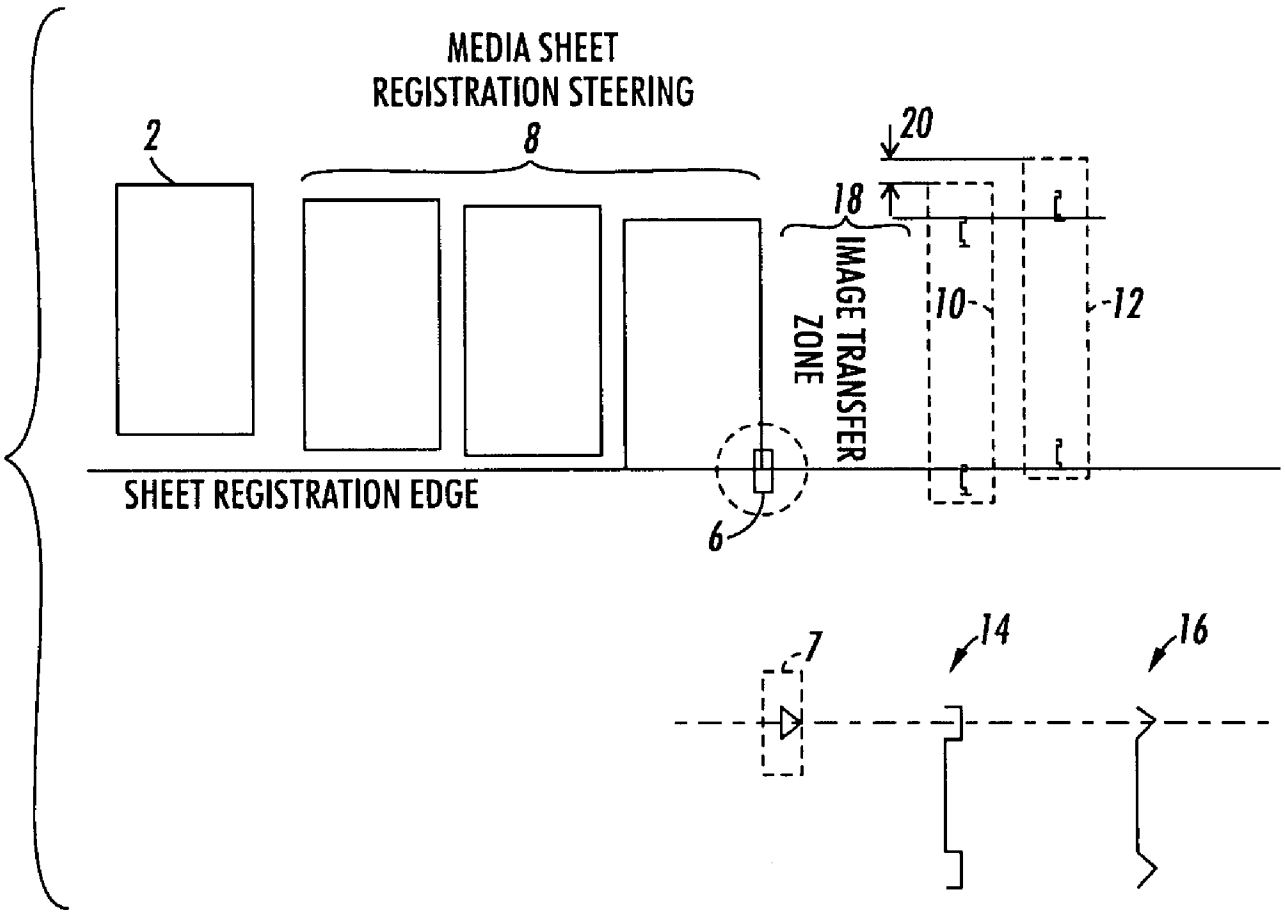
FIG. 1 is a schematical representation of a printing apparatus according to an exemplary embodiment of this disclosure.

With reference to FIG. 1, illustrated is a schematical representation of a printing apparatus according to an exemplary embodiment of this disclosure. Substantially, to smooth the outboard edge wear areas 164 and 168 and inboard edge wear areas 170 and 174 as discussed with reference to FIG. 7, media sheets are steered to alternate target positions related to the registration of media sheets during a fuser roll dwelling or reversing mode. The alternate target positions may be determined on a sheet by sheet basis to produce a triangular shaped profile 7.

The printing apparatus comprises one or more media sheets 2, a media sheet registration steering system 8, a fuser assembly RDS traveling a predetermined distance 20 and including a fuser roll travel inboard limit 10 and outboard limit 12, an image transfer zone 18 where an image is initially fixed to a processed media sheet, and a media sheet edge position sensor 6. Notably, the image transfer zone registers/positions and initially fixes an image to the media sheets relative to the media sheet registration target position indicated by the media sheet edge position sensor 6.

In operation, the RDS continuously moves the fuser roll laterally back and forth between an outboard travel limit and an inboard travel limit. As the RDS travels substantially within the outboard travel limit 12 and the inboard travel limit 10, the media sheet registration system steers media sheets to a first target position as determined by the media sheet edge position sensor 6. As the RDS approaches the outboard 12 or inboard limits 10, the RDS will first enter a dwell mode where the fuser roll will be stationary just prior to the RDS motor reversing the lateral movement direction of the RDS and associated fuser roll. Notably, prior to the RDS entering the dwell mode, the media sheet registration steering system 8 steers media sheets to alternate target positions. For example, the alternate target positions of media sheets may be on a sheet by sheet basis and include a triangular profile distribution 7. The effect of steering the media sheets to alternate target positions while the RDS is in dwell or reversing mode is to smooth the fuser roll edge wear areas 14 produced by the RDS. The results are fuser roll inboard and outboard limit boundaries which include a smoother profile 16. This smoother profile 16 of the edge wear area boundaries extends the useful life of the fuser roll.

Figure 2:
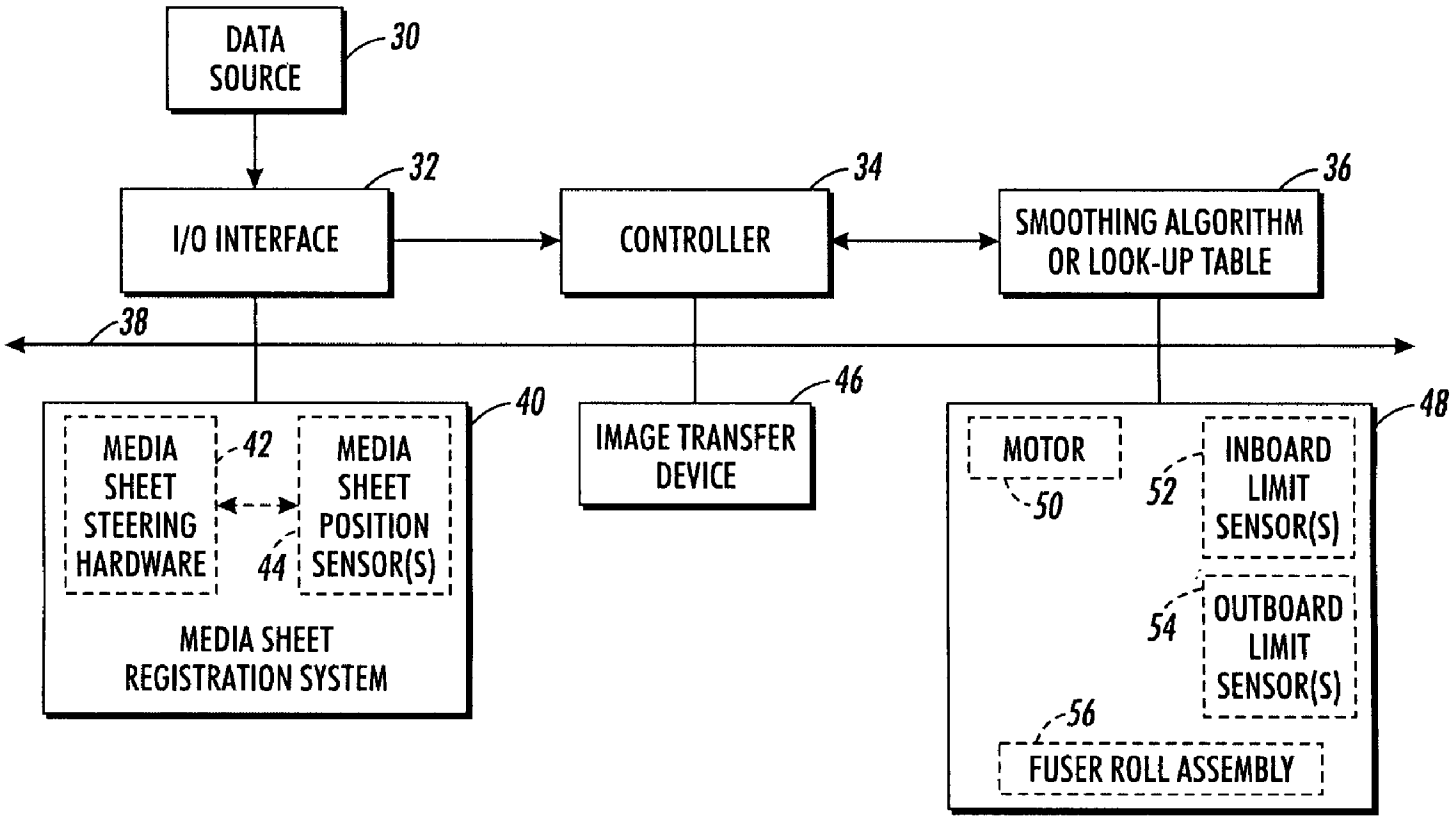
FIG. 2 is a block diagram of a printing system according to an exemplary embodiment of this disclosure.

With reference to FIG. 2, illustrated is a block diagram of a printing system according to an exemplary embodiment of this disclosure. The printing system comprises a data source 30, an I/O interface 32, a controller 34, an edge smoothing algorithm or look-up table 36, a communication interface 38, a media sheet registration system 40, an image transfer device 46 and a fuser roll assembly including an RDS 48. The media sheet registration system 40 comprises media sheet steering hardware and media sheet position sensor(s) 44. The fuser roll device assembly RDS 48 comprises a RDS motor 50, RDS/fuser roll inboard limit sensor(s) 52, RDS/fuser roll outboard limit sensor(s) 54 and a fuser roll assembly 56.

Figure 3:
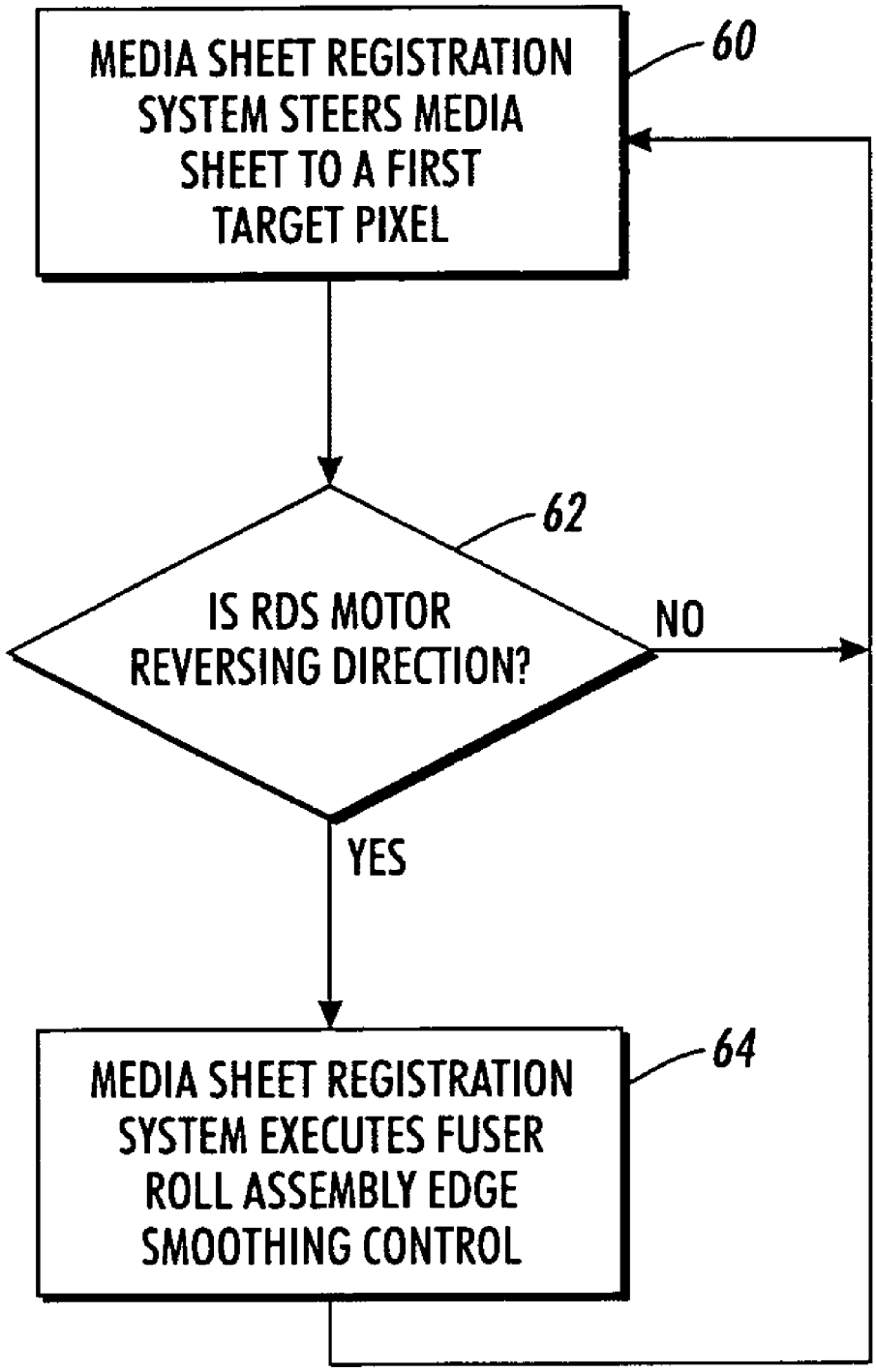
FIG. 3 illustrates a method of operating a media sheet registration system according to an exemplary embodiment of this disclosure.

With reference to FIG. 3, illustrated is a flow chart of an exemplary method of operating a media sheet registration system according to this disclosure. Substantially, the method comprises a media sheet registration system steering a media sheet to a first target pixel 60 and monitoring the state of the fuser roll RDS to determine if the RDS motor is reversing 62 the direction of the fuser roll, i.e. the RDS is in a dwell mode or the RDS motor is driving the fuser roll in a relative reverse direction.

If the RDS motor is not reversing direction, the media sheet registration system continues to steer media sheets to the first target pixel 60.

If the RDS motor is reversing direction, the media sheet registration system executes a fuser roll assembly edge smoothing control system 64 as described with reference to FIG. 1.

The media sheet registration system returns to steering media sheets to the first target pixel 60 after completing the execution of the fuser roll assembly edge smoothing control 64.

Figure 4:
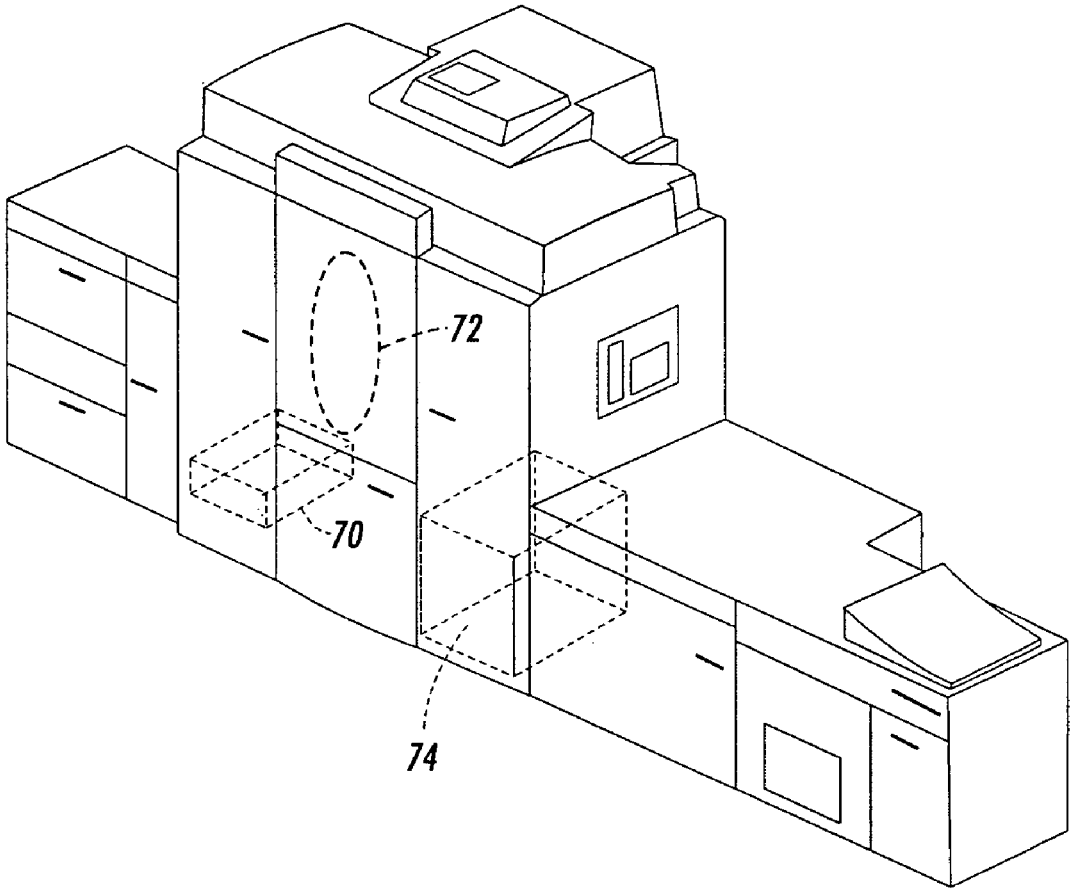
FIG. 4 illustrates a printing system according to an exemplary embodiment of this disclosure.

With reference to FIG. 4, illustrated is a printing system according to an exemplary embodiment of this disclosure. The printing system comprises a media sheet registration system module 70, an image marking module 72 and a fuser assembly module 74.

Figure 5:
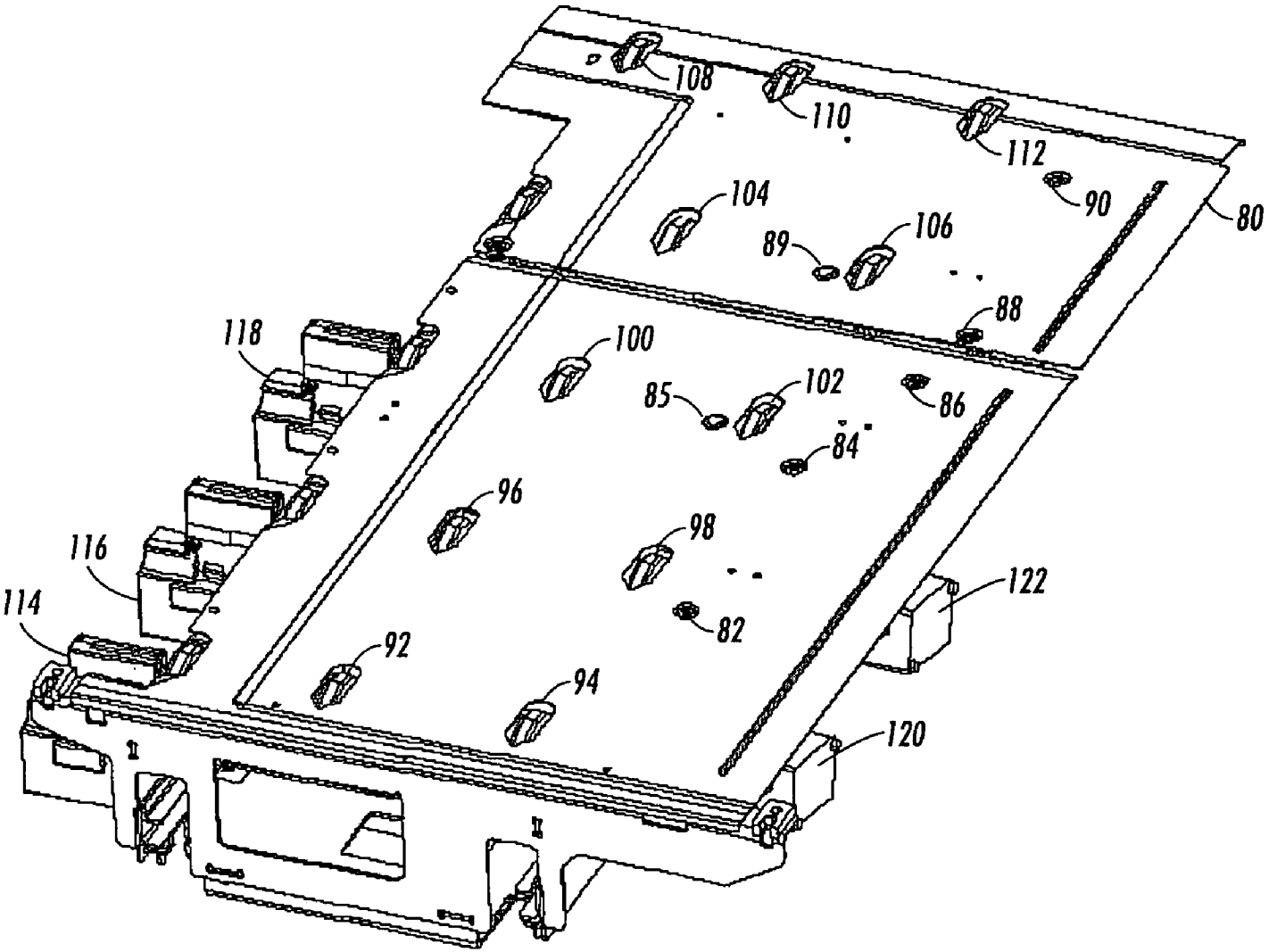
FIG. 5 illustrates a media sheet registration module according to an exemplary embodiment of this disclosure.

With reference to FIG. 5, illustrated is a media sheet registration module according to an exemplary embodiment of this disclosure. The media sheet registration module comprises a frame 80, sensors 82, 84, 85, 86, 88, 89 and 90, nip rollers 92, 94, 96, 98, 100, 102, 104, 106, 108, 110 and 112, media sheet registration sensors 114, 116 and 118, and nip roller drives 120 and 122.

By way of example, the media sheet registration sensors 114, 116 and 118 may include an array of target pixels for determining the position of a media sheet. For example, a charged coupled device including 1024 pixels. Moreover, other media sheet registration sensors and systems known to those of skill in the art presently and in the future are within the scope of this disclosure.

In operation, the media sheet registration system illustrated in FIG. 5 steers and registers a media sheet by differentially driving the nip rollers. Specifically, the nip roller drive motors differentially drive the nip rollers using velocity profiles to steer a media sheet.

Figure 6:
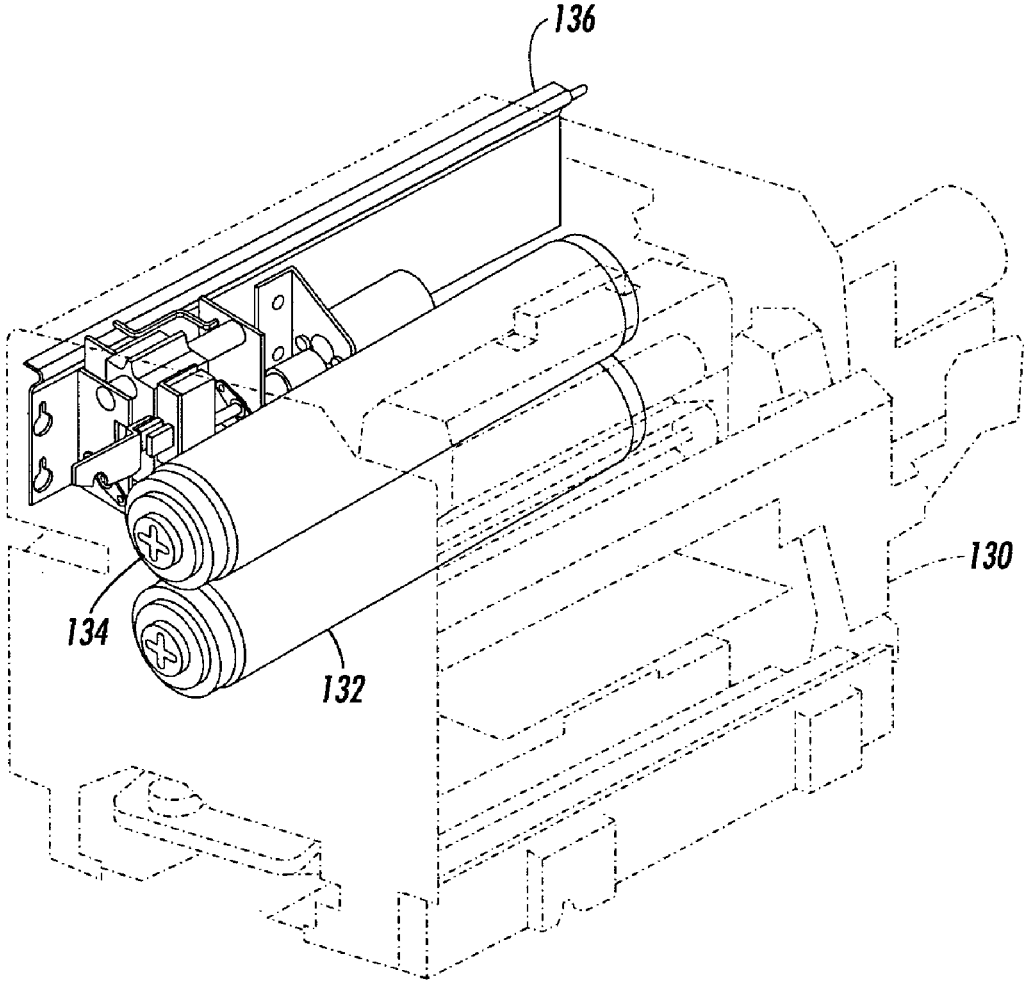
FIG. 6 illustrates a fusing module according to an exemplary embodiment of this disclosure.

With reference to FIG. 6, illustrated is a fuser roll assembly module according to an exemplary embodiment of this disclosure. The fuser roll assembly module comprises a frame 130, fuser rolls 132 and 134, and a fuser roll RDS 136.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing apparatus comprising:

a media sheet registration system;

an image transfer device operatively connected to the media sheet registration system;

a fuser roll assembly operatively connected to the image transfer device; and a fuser roll registration distribution system (RDS) operatively connected to the fuser roll assembly, wherein the fuser roll registration distribution system changes the position of the fuser roll assembly to increase the fuser roll assembly edge wear area associated with media sheet edges passing through the fuser roll assembly, and the printing apparatus is adapted to steer a sequence of media sheets to a plurality of media sheet registration positions to smooth the fuser roll assembly edge wear area associated with media sheet edges passing through the fuser roll assembly.

2. The printing apparatus according to claim 1, the fuser roll registration distribution system further comprising:

a drive motor operatively connected to the fuser roll assembly, wherein the drive motor continuously moves one or more fuser rolls operatively connected to the fuser roll assembly back and forth in a lateral motion to increase the fuser roll assembly edge wear area associated with media sheet edges passing through the fuser roll assembly.

3. The printing apparatus according to claim 2, the fuser roll registration distribution system further comprising:

one or more sensors to detect the position of the one or more fuser rolls.

4. The printing apparatus according to claim 3, wherein the one or more sensors detect a predetermined outboard travel limit and a predetermined inboard travel limit, and the drive motor reverses direction at the outboard and inboard travel limits.

5. The printing apparatus according to claim 4, wherein the media sheet registration system steers media sheets to a first target position as the one or more fuser assembly rolls continuously move in a constant direction substantially within the outboard travel limit and the inboard travel limit, and the media sheet registration system steers media sheets to a second target position as the motor reverses direction substantially near one or both of the outboard travel limit and the inboard travel limit.

6. The printing apparatus according to claim 5, wherein the second target position is determined on a sheet by sheet basis to smooth fuser roll assembly edge wear associated with one or both of reversing the direction of the motor and fuser roll dwell.

7. The printing apparatus according to claim 6, wherein the second target position comprises a target position offset from the first target position in an outboard or inboard lateral direction.

8. The printing apparatus according to claim 7, wherein the second target position is incremented by a predetermined distance for each media sheet passing through the fuser roll assembly incremental predetermined distance and the second target position reverses direction after reaching a predetermined maximum distance from the first target position.

9. The printing apparatus according to claim 8, wherein the media sheet registration system comprises a fuser roll assembly edge smoothing control, system, wherein the edge smoothing control system executes a control algorithm or accesses a lookup table to determine the incremented second target positions.

10. The printing apparatus according to claim 5, the media sheet registration system further comprising:

one or more charge coupled device (CCD) sensor assemblies for detecting a media sheet edge position.

11. The printing apparatus according to claim 10, wherein the one or more charge coupled device sensor assemblies comprises an array of pixels.

12. A method of smoothing the edge wear area associated with a fuser roll assembly operatively connected to a fuser roll assembly registration distribution system RDS), the roll RDS driving the fuser roll assembly laterally back and forth within an outboard travel limit and an inboard travel limit, the method comprising:

registering one or more media sheets at a first target position while the RDS drives the fuser roll assembly substantially between the outboard travel limit and the inboard travel limit; and registering one or more media sheets at a second target position while the RDS operates in a dwell mode and/or reverse mode.

13. The method according to claim 12, further comprising:

determining the second target position on a media sheet by media sheet basis.

14. The method according to claim 13, further comprising:

incrementing the second target position by a predetermined distance for a sequence of media sheets.

15. The method according to claim 14, further comprising:

incrementing the second target position to a predetermined outboard limit, then incrementing the second target position to a predetermined inboard limit.

16. The method according to claim 14, further comprising:

executing a control algorithm to determine the second target position.

17. The method according to claim 16, further comprising:

accessing a look-up table to determine the second target position.

18. A method of operating a printing system comprising:

a media sheet registration system;

an image transfer device operatively connected to the media sheet registration system;

a fuser roll assembly operatively connected to the image transfer device; and a fuser roll registration distribution system (RDS) operatively connected to the fuser roll assembly, wherein the RDS travels back and forth in a lateral direction within a predetermined outboard travel limit and inboard travel limit to increase the fuser roll assembly edge wear area associated with media sheet edges passing through the fuser roll assembly, the method of operating the printing system comprising:

registering one or more media sheets at a first target position prior to image marking the one or more media sheets and while the RDS travels in a lateral direction substantially between the outboard travel limit and the inboard travel limit;

transferring an image from the image marking device to the one or more media sheets, wherein the image is registered on the media sheets relative to the first target position;

fusing the image on the one or more media sheets while the fuser roll assembly is positioned between the RDS outboard travel limit and the RDS inboard travel limit;

determining the fuser roll assembly RDS is in a dwell mode of operation and/or a reversing mode of operation, wherein the fuser roll assembly is substantially positioned at the outboard travel limit or inboard travel limit;

registering one or more media sheets at a second target position prior to image marking the one or more media sheets;

transferring an image from the image marking device to the one or more media sheets, wherein the image is registered no the media sheets relative to the second target position;

fusing the image on the one or more media sheets while the fuser roll assembly is substantially positioned at the outboard travel limit or inboard travel limit; and determining the fuser roll assembly RDS is operating at a predetermined distance from the outboard travel limit and inboard travel limit; and returning to registering one or more media sheets at the first target position prior to image marking the one or more media sheets and while the RDS travels in a lateral direction substantially between the outboard travel limit and the inboard travel limit.

19. A xerographic apparatus comprising:

a media sheet feeder module;

a media sheet registration system operatively connected to the media sheet feeder module;

an image marking module operatively connected to the media sheet registration system; and a fuser module operatively connected to the image marking module, wherein the fuser module comprises a RDS and the media sheet registration system steers a sequence of media sheets to a plurality of registration positions to smooth edge wear associated with the media sheets passing through the fuser module.

20. The xerographic apparatus according to claim 19, further comprising a media sheet finishing module operatively connected to the fuser module.

* * * * *